US010066907B2

(12) United States Patent
Pixton

(10) Patent No.: US 10,066,907 B2
(45) **Date of Patent: *Sep. 4, 2018**

(54) TARGET STAND

(71) Applicant: Greyman LLC, Draper, UT (US)

(72) Inventor: Todd W Pixton, Draper, UT (US)

(73) Assignee: Greyman LLC, Draper, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/747,835

(22) Filed: Jun. 23, 2015

(65) Prior Publication Data

US 2015/0292842 A1 Oct. 15, 2015

Related U.S. Application Data

(63) Continuation-in-part of application No. 14/520,165, filed on Oct. 21, 2014.

(Continued)

(51) Int. Cl.
*F41J 1/10* (2006.01)

(52) U.S. Cl.
CPC ..... *F41J 1/10* (2013.01)

(58) Field of Classification Search
CPC ... F41J 1/10; F41J 3/0004; B25H 1/06; A47C 4/021; G09F 15/0062

(Continued)

(56) References Cited

U.S. PATENT DOCUMENTS 2,911,265 A * 11/1959 Hannah ..... A47B 3/12 182/186.5

3,035,660 A * 5/1962 Leon ..... A47B 13/021 182/151

(Continued)

FOREIGN PATENT DOCUMENTS

| | | |
|---|---|---|
| CN | 201253040 | 6/2009 |
| DE | 202005017459 | 12/2005 |
| WO | WO 2004042237 | 5/2004 |

OTHER PUBLICATIONS

Kimble et al, "Target Stands for Shooting Practice", http://thekimblefamily.com/index.php/projects/small-projects/target-stands, Jul. 2010, pp. 2, Firestone Colorado.

(Continued)

*Primary Examiner* — Mark Graham
(74) *Attorney, Agent, or Firm* — Thorpe North & Western, LLP

(57) ABSTRACT

A target stand is disclosed and described. The target stand can include a first side member and a second side member. Each side member can have a base portion, and an upright portion extending from the base portion. The upright portion can have a lower engagement feature and an upper engagement feature. The target support can also include a first transverse member and a second transverse member. Each transverse member can have a main body portion with a target support portion, and complimentary engagement features extending from opposite ends of the main body portion. The upper and lower engagement features can be securable to the transverse members. A distance between the upper engagement features can be different than a distance between the lower engagement features such that the transverse members bind with the first and second side members and cause the first and second side members to be disposed at an angle relative to one another when assembled.

17 Claims, 7 Drawing Sheets

Related U.S. Application Data

(60) Provisional application No. 61/961,641, filed on Oct. 21, 2013.

(58) Field of Classification Search
USPC ..... 273/403–407; 40/610, 611.13; 248/165; 182/186, 186.1–186.5
See application file for complete search history.

(56) References Cited

U.S. PATENT DOCUMENTS 3,987,737 A 10/1976 Smith
4,105,091 A * 8/1978 Mahan ..... B25H 1/06 182/151
4,191,113 A * 3/1980 Hogberg ..... A47C 4/021 108/157.16
4,364,562 A * 12/1982 White ..... A63B 69/0097 273/407
4,403,554 A 9/1983 Valentine et al.
4,433,753 A * 2/1984 Watson ..... B25H 1/06 182/151
4,520,584 A * 6/1985 Howard ..... G09F 15/0056 40/124.19
4,691,925 A 9/1987 Scholem
4,756,384 A * 7/1988 Maddox ..... B25H 1/06 116/63 P
4,811,956 A * 3/1989 Foreman ..... F41J 1/10 273/407
4,884,658 A * 12/1989 Banfield ..... B25H 1/06 182/129
5,067,683 A 11/1991 Wager
5,280,920 A 1/1994 Knapper, II
5,443,168 A 8/1995 Dyment et al.
5,479,732 A 1/1996 Burtch et al.
5,522,574 A 6/1996 Maglione
5,526,897 A * 6/1996 Schiller ..... B23D 47/025 182/129
5,644,995 A 7/1997 Gurwell et al.
5,851,001 A 12/1998 Dicke et al.
6,382,433 B1 5/2002 Podergois
6,491,303 B1 12/2002 Huston
6,581,895 B1 6/2003 Pleasant
6,827,028 B1 12/2004 Callaway
7,111,708 B2 * 9/2006 Frey ..... B25H 1/06 182/151
7,325,808 B1 * 2/2008 Adler ..... F41J 1/08 273/406
7,422,217 B2 9/2008 Hinnant
7,427,069 B2 9/2008 Bateman et al.
8,505,921 B2 8/2013 Amodt
2012/0227298 A1 * 9/2012 Alicea ..... G09F 15/0062 40/610
2013/0001880 A1 * 1/2013 Dean ..... F41J 1/10 273/407
2013/0147119 A1 * 6/2013 Matthis ..... F41J 1/10 273/407
2014/0026453 A1 * 1/2014 Weis ..... G09F 15/0012 40/606.15
2014/0252719 A1 9/2014 Johnson
2015/0276356 A1 * 10/2015 Cesternino ..... F41J 9/02 273/370
2015/0330747 A1 * 11/2015 Ferrell ..... F41J 1/10 273/407

OTHER PUBLICATIONS

Law Enforcement Targets Inc, "Target Stands", https://www.letargets.com search as accessed on Sep. 15, 2014, pp. 5.

* cited by examiner

TARGET STAND

RELATED APPLICATION(S)

This application is a continuation-in-part of U.S. patent application Ser. No. 14/520,165, filed Oct. 21, 2014, which claims priority to U.S. Provisional Patent Application Ser. No. 61/961,641, filed Oct. 21, 2013, which are each incorporated herein by reference.

BACKGROUND

Traditional target stands are designed for either steel targets or paper targets and are often extremely bulky in both size and weight, which makes them difficult to transport to and from the shooting range or other location. Some target stands are constructed from wood or metal, and are held together with an independent fastener to make an H frame type base structure, which in turn holds an upright post to which a target is affixed. These target stands are heavy and awkward because of the fixed size. In addition, these target stands are not readily disassembled or require a hand or power tool to assemble and/or disassemble.

SUMMARY

A target stand is disclosed that is easily portable and can be readily assembled and/or disassembled for use in the field or at the range. The target stand can include a first side member and a second side member. Each side member can have a base portion, and an upright portion extending from the base portion. The upright portion can have engagement features which can optionally include a lower engagement feature and an upper engagement feature. The target support can also include a first transverse member and a second transverse member. Each transverse member can have a main body portion with a target support portion for interfacing with a target support, and complimentary engagement features extending from opposite ends of the main body portion. The complimentary engagement features of each transverse member can be securable to corresponding engagement features of the first and second side members to secure each transverse member to the first and second side members. The complimentary engagement features of the second transverse member can be securable to the engagement features of the first and second side members to secure the second transverse member to the first and second side members. A distance between an upper portion of each side member can be different than a distance between a lower portion of the side members such that the transverse members bind with the first and second side members and cause the first and second side members to be disposed at an angle relative to one another when assembled.

In one aspect, a target stand system is provided. The system can include a target, a target support coupled to the target and configured to position the target, and a target stand engaged with the target support. The target stand can include a first side member and a second side member. Each side member can have a base portion, and an upright portion extending from the base portion. The upright portion can have a lower engagement feature and an upper engagement feature. The target support can also include a first transverse member and a second transverse member. Each transverse member can have a main body portion with a target support portion for interfacing with the target support, and complimentary engagement features extending from opposite ends of the main body portion. The complimentary engagement features of the first transverse member can be securable to the engagement features of the first and second side members to secure the lower transverse member to the first and second side members. The complimentary engagement features of the second transverse member can be securable to corresponding engagement features of the first and second side members to secure the second transverse member to the first and second side members. A distance between the upper engagement features can be different than a distance between the lower engagement features such that the transverse members bind with the first and second side members and cause the first and second side members to be disposed at an angle relative to one another when assembled.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
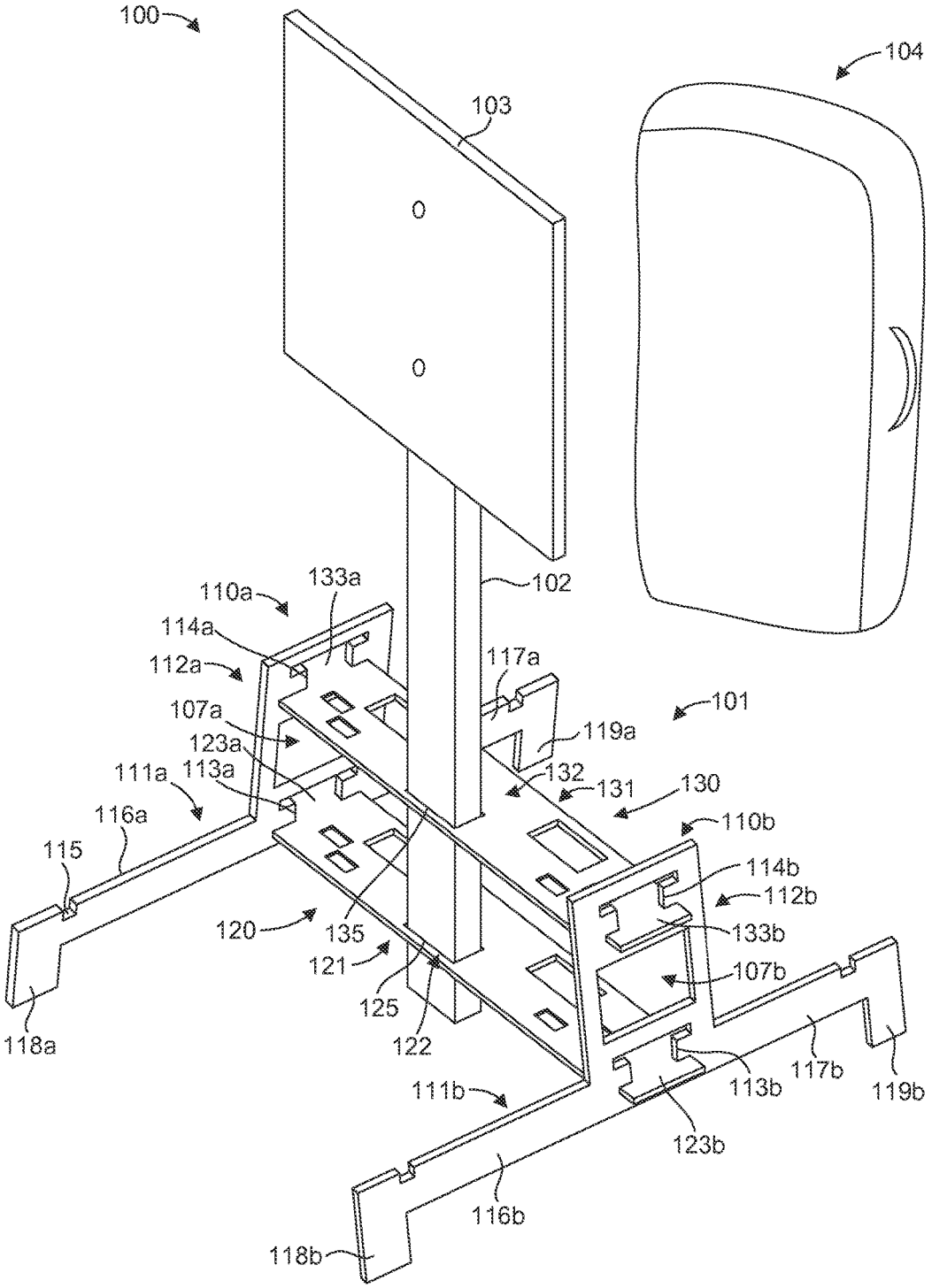
FIG. 1 illustrates a target stand system having a target stand in accordance with an example of the present disclosure.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "a notch" includes reference to one or more of such features and reference to "engaging" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As used herein, the term "at least one of" is intended to be synonymous with "one or more of" For example, "at least one of A, B and C" explicitly includes only A, only B, only C, or combinations of each.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Target Stand

Figure 2:
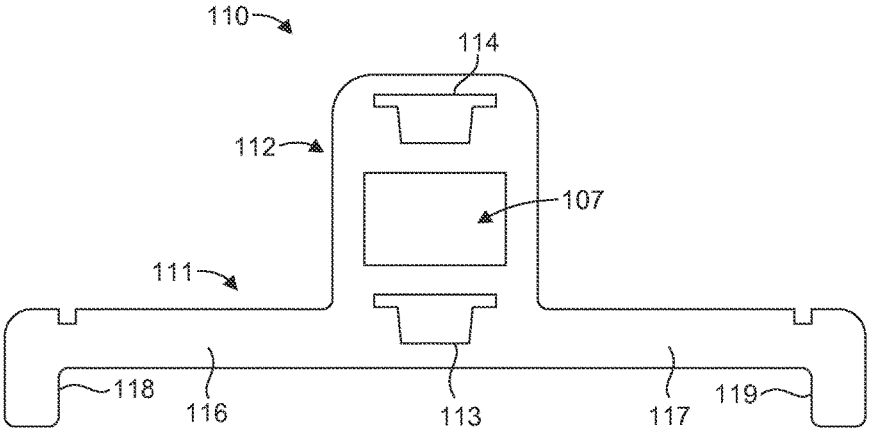
FIG. 2 illustrates a side member of a target stand in accordance with an example of the present disclosure.
Figure 3:
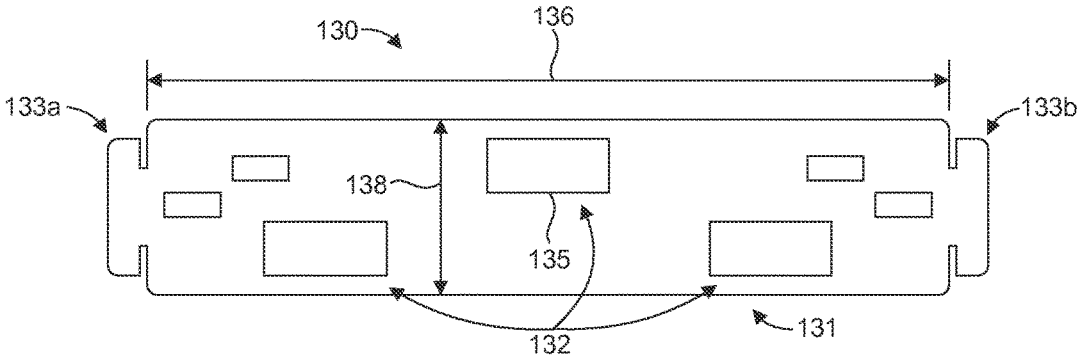
FIG. 3 illustrates an upper transverse member of a target stand in accordance with an example of the present disclosure.
Figure 4:
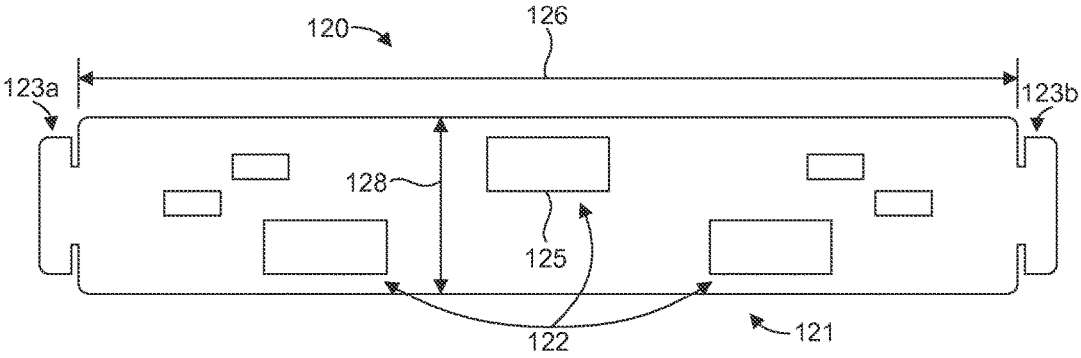
FIG. 4 illustrates a lower transverse member of a target stand in accordance with another example of the present disclosure.

With reference to FIG. 1, a target stand system 100 is illustrated in accordance with an example of the present disclosure. The system can include a target stand 101, a target support 102, and a target 103. The target stand can be engaged with the target support, which can be coupled to the target and configured to position the target. The target can comprise any type of target and can be constructed of any suitable material, such as metal (e.g., steel), cardboard, paper, etc. The target stand can include side members 110*a*, 110*b* and transverse members 120, 130. In one aspect, the side members can be identical to one another. A single side member 110 is shown isolated for clarity in FIG. 2, which includes reference numbers corresponding to those of FIG. 1. Similarly, transverse members 120, 130 are shown isolated for clarity in FIGS. 3 and 4, respectively, which include the same reference numbers shown in FIG. 1. Corners of each member are shown with optional rounded edges in FIGS. 3 and 4 as opposed to FIG. 1 which shows rigid 90° corners. Rounded corners can reduce potential injury during assembly and improve appearance, although either corner profile can be suitable.

Each transverse member 120, 130 can have a main body portion 121, 131 with a target support portion 122, 132 for interfacing with the target support 102. The target support portion can include any suitable number of target support openings 125, 135 configured to interface with the target support 102. Multiple target support openings for each transverse member can enable the target stand to engage multiple target supports. In one aspect, target support openings can be configured to interface with any suitable target support size, shape, or configuration. For example, the target support can comprise a piece of 2×4 dimensional lumber and/or a piece of 1×2 dimensional lumber, and the target support openings can be sized accordingly. In one aspect, the location of the target support openings can be configured to provide multiple target options simultaneously. For example, one target opening can be associated with a target located slightly in front and/or to a side of a target opening associated with another target. In one example, larger target support openings can be distributed to accommodate supports for various target types. In one example, two larger target support openings can be spaced about 15 inches on center, or from 10 to 20 inches apart. For example, two larger support openings can be aligned along a rear edge of the corresponding transverse member, with a third larger support opening centered between the two larger support openings and aligned along a leading edge as illustrated. Similarly, smaller target support openings can be distributed in each of the transverse members. For example, pairs of smaller target support openings can be spaced apart from 10 to 30 inches apart on center, and in some cases about 17 and about 26 inches apart. In another optional aspect, the transverse members can be directly or indirectly coupleable to one another. For example, one or more secondary panels can be secured via flanges or other engagement features between the transverse members in order to provide additional stability.

Figure 5A:
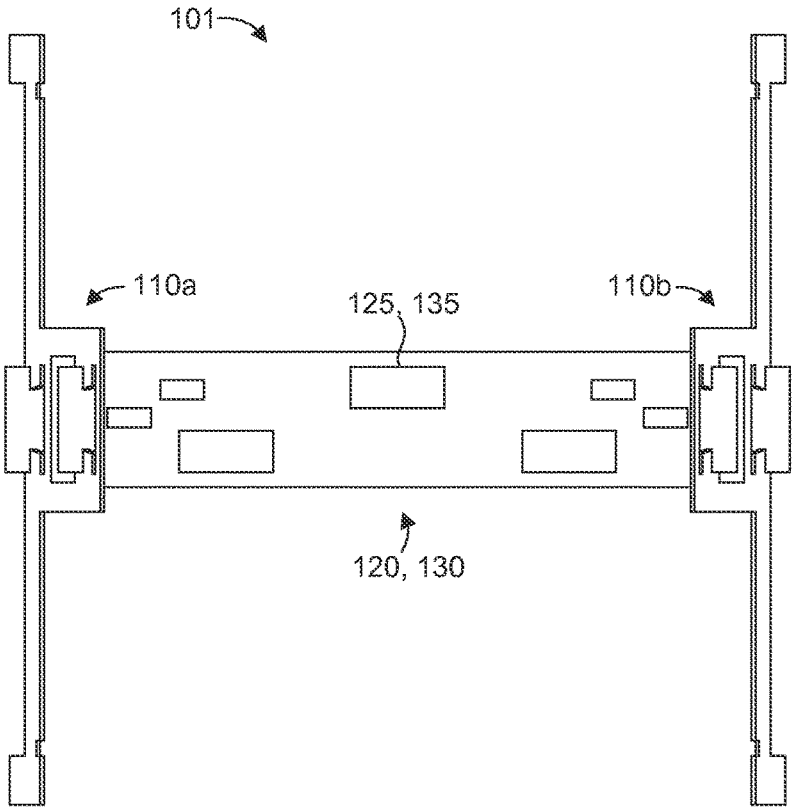
FIG. 5A is a top view of the target stand of FIG. 1.
Figure 5B:
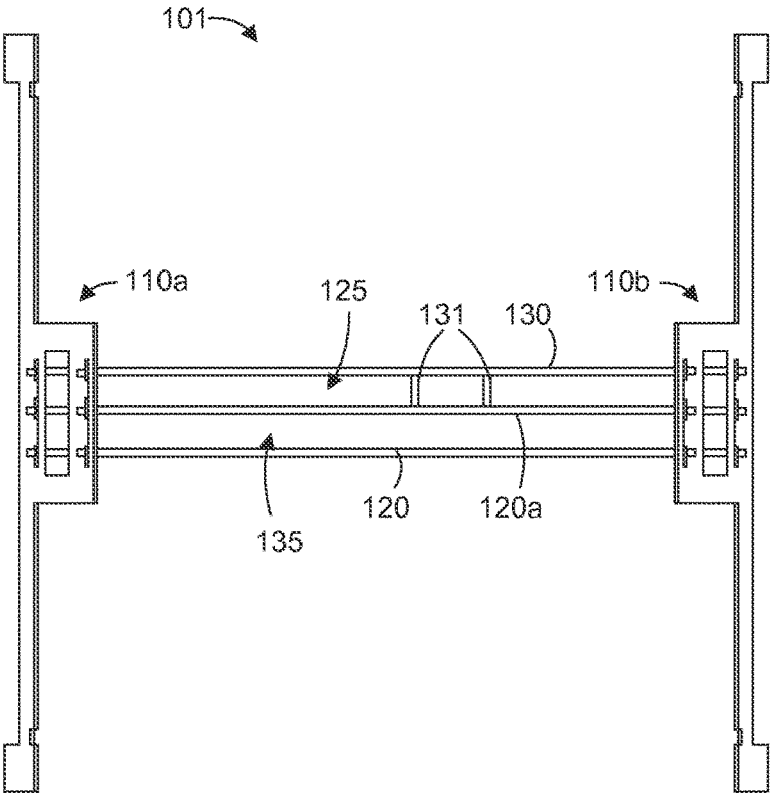
FIG. 5B is a top view of a target stand having horizontally distributed transverse members in accordance with another example of the present disclosure.

Thus, with target supports of various heights, multiple targets can be supported by the target stand at the same time. In another aspect, two target openings can be associated with a single target, such as by interfacing with two different target supports that are coupled to and support opposite sides of the same target. Although two transverse members are illustrated, it should be recognized that the target stand can include any suitable number or orientation of transverse members in accordance with the principles disclosed herein. In general, it is desirable to have at least two transverse members interfacing with a target support in order to adequately constrain the target support against vertical moment, although a single transverse member may suffice. In one option, the transverse members can be vertically spaced apart a sufficient distance to reduce movement of the target support. In some cases the vertical distance can be from 2 to 12 inches. For example, as illustrated in a top view of the target stand (FIG. 5A), the target support openings 125, 135 can be configured to be vertically spaced and vertically aligned with one another when assembled to maintain the target support in a vertical orientation. Similarly, one or more transverse members can be horizontally spaced apart such that movement of the target support and position of the side members can be maintained relative to one another in an angled and non-perpendicular position (FIG. 5B). Notice in FIG. 5B, transverse member 120, 120*a*, and 130 are horizontally spaced and lie in a plane perpendicular to the illustration page. In this example, three transverse members are used to form corresponding target support openings 125 and 135. Optional retaining walls 131 can also be used to secure target support members against lateral movement within the openings. Engagement features can include tabs, slits or other features such as those previously outlined. Optionally, the target support members can further include pins, bolts, clasps, or other tensioning mechanisms which secure target support members within the target support openings. Regardless, the transverse members can be configured in any manner to retain the angled side members with respect to one another.

Each side member 110*a*, 110*b* can have a base portion 111*a*, 111*b* and an upright portion 112*a*, 112*b* extending from the base portion. In one aspect, the base portion 111*a*, 111*b* can include an extension arm 116*a*, 117*a*, 116*b*, 117*b* to provide stability for the target stand 101. In another aspect, the base portion can include one or more support feet 118*a*, 119*a*, 118*b*, 119*b* extending from a corresponding extension arm to interface with a support surface such that the base portion is raised above the support surface to provide stability for the target stand 101 on uneven surfaces. In one example the support feet can raise the base portion from 1 to 3 inches, and in one example 2 inches. However, the support feet can be of any suitable size, shape, or configuration. In one aspect, the base portion can have extension arms without support feet such that the extension arms rest directly along the support surface along lower edges of the extension arms. In one aspect, the side members, particularly the extension arms, can be configured to provide fore/aft stability for the target support. Thus, in one example, the extension arms can have a length from 7 to 15 inches, and one example 11 inches. In another aspect, the transverse members can be configured to provide lateral stability for the target support, such as by positioning the side members an adequate distance from one another either vertically and/or horizontally. In another example, an upper transverse member can have a spacing length from 12 to 30 inches, and in one example about 23¼ inches. Similarly, a lower transverse member can have a spacing length from 18 to 36 inches, and in one example about 27¼ inches. The size of the side members and the transverse members can therefore vary and can be dependent on the particular target(s) being supported and the conditions under which the target stand will be used. In one aspect, the base portion can include a securing feature 115, such as a notch, configured to facilitate securing or coupling the target stand 101 to a support surface (e.g., via a stake) or a stable object, such as a rock, tree, etc. (e.g., via a rope). The securing feature can optionally include an aperture, carabineer, pin, flexible loop, or the like.

Generally, the side members can each include at least one engagement feature which is adapted to couple with complimentary engagement features on one or more transverse members. One or more engagement features can be used. Typically, these engagement features can include two features which are vertically spaced as a pair, although horizontally spaced features can also be used. In one illustrated example, the upright portion 112*a*, 112*b* of each side member 110*a*, 110*b* can have a lower engagement feature 113*a*, 113*b* and an upper engagement feature 114*a*, 114*b*. In addition, each transverse member 120, 130 can have complimentary engagement features 123*a*, 123*b*, 133*a*, 133*b* extending from opposite ends of the main body portion 121, 131. These complimentary engagement features can be oriented in any manner sufficient to secure the side members in the angled position. In one example, the complimentary engagement features 123*a*, 123*b* of the lower transverse member 120 are securable to the lower engagement features 113*a*, 113*b* of the side members to secure the lower transverse member to the side members. The complimentary engagement features 133*a*, 133*b* of the upper transverse member 130 are securable to the upper engagement features 114*a*, 114*b* of the side members to secure the upper transverse member to the side members. Alternatively, when orienting transverse members horizontal to one another, complimentary engagement features of the transverse member can engage corresponding engagement features in the side members. For example, the complimentary engagement features of the transverse members can be secured to either or both the upper and lower engagement features on each side member. Thus, the engagement features can be distributed in any configuration sufficient to provide stability, while the transverse members secure the side members in an angled, non-parallel orientation.

Figure 7A:
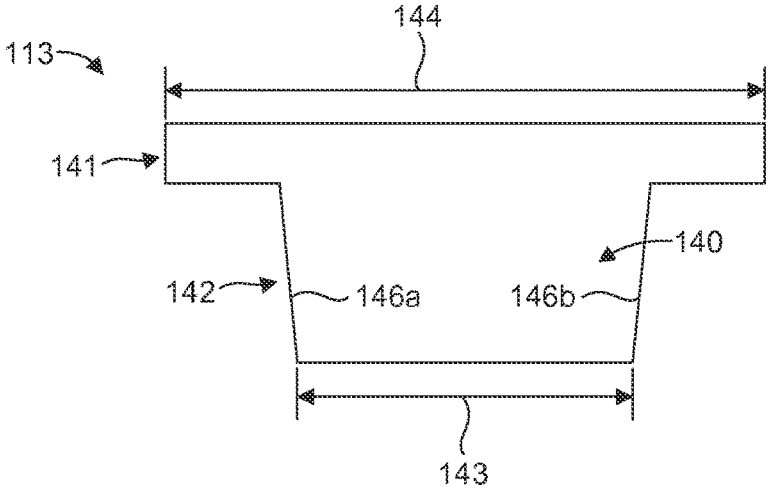
FIG. 7A is a detailed view of an engagement feature of the side member of FIG. 3.
Figure 7B:
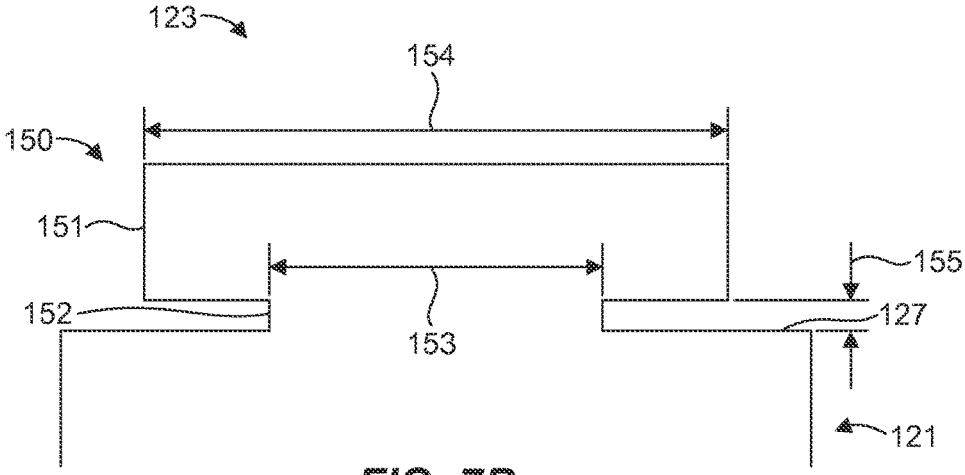
FIG. 7B is a detailed view of an engagement feature of the transverse member of FIG. 3 and/or FIG. 4.

The engagement features and complementary engagement features can be of any suitable type or configuration. For example, such engagement features can comprise a tab, a slot, a notch, a hook, a tongue, a groove, a hitch, a pin, a fastener (e.g. a bolt, a screw, etc.), an adhesive, a weld, a bend, etc., alone or in any combination. In one aspect, the engagement features can be configured for assembly and/or disassembly without tools. Thus, in one example, the engagement features can include at least one of a tab, slot notch, tongue, hitch, and pin. Examples of such engagement features are illustrated in FIGS. 7A and 7B and discussed in more detail below.

Figure 6:
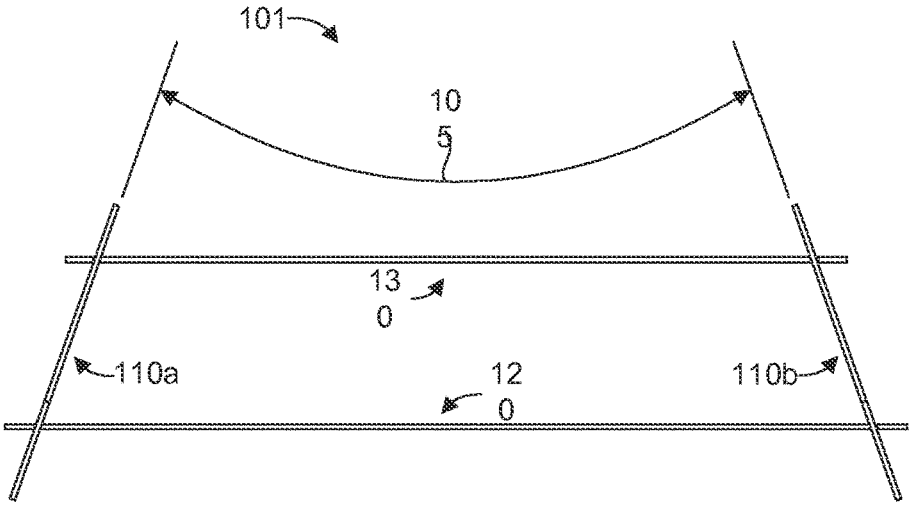
FIG. 6 is a front view of the target stand of FIG. 1.

Generally, each of the side members can be disposed such that an upper portion of each side member is oriented a distance which is shorter than a distance between lower portions of the side members such that the side members are angled with respect to one another. In one aspect, a distance 136 (FIG. 3) between the complimentary engagement features 133*a*, 133*b* of the upper transverse member 130 can be different than a distance 126 (FIG. 4) between the complimentary engagement features 123*a*, 123*b* of the lower transverse member 120 such that the lower and upper transverse members bind with the side members 110*a*, 110*b* and cause the side members to be disposed or tilted at an angle 105 (FIG. 6) relative to one another when assembled. In one specific example, the engagement features are tabs which include an enlarged portion with partial grooves therein. During use, the grooves align with corresponding openings 114 and have a width slightly larger than a plate thickness of the side members. In one example, the width can be from 1/32 to 1/8 inch larger than the thickness. As the side members are angled, corner edges of the grooves engage against outer sides of the side members. In a particular aspect, the distance 126 between the complimentary engagement features of the upper transverse member is less than the distance 136 between the complimentary engagement features of the lower transverse member, such that top ends of the side members are angled toward one another. Regardless of the number and orientation of the transverse members, the angle between the side members created by the different lengths 126, 136 can provide stability to the target stand in that the side members and interfacing transverse members can wedge or bind together to reduce or minimize relative movement between the interfacing components. In addition, this configuration can enhance the ability of the transverse members to provide lateral stability to the target stand.

The target stand 101 can be assembled by arranging the side members 110*a*, 110*b* parallel to one another with a space between them to accommodate the transverse members 120, 130. The lower transverse member 120 can then be coupled to the side members by securing the complimentary engagement features 123*a*, 123*b* of the lower transverse member to the lower engagement features 113*a*, 113*b* of the side members. Similarly, the upper transverse member 130 can then be coupled to the side members by securing the complimentary engagement features 133*a*, 133*b* of the upper transverse member to the upper engagement features 114*a*, 114*b* of the side members. It should be recognized that other methods of assembling the target stand are contemplated and that the components of the target stand can be assembled in any suitable order. The present disclosure therefore provides independent side members and transverse members that can be assembled to form a self-supporting target stand.

The various components of the target stand 101 can be constructed of any suitable material, such as metal (e.g., steel, aluminum, etc.) composite materials (e.g., carbon fiber, fiberglass, metal matrix composites, etc.), wood, plastic, or any other suitable natural or synthetic material. In one aspect, the side members 110*a*, 110*b* and/or the transverse members 120, 130 can be formed of metal plates having a thickness from about 1/16" to about 1/4", and in one example 3/16". Thus, in one aspect, illustrated in FIG. 6, a frontal area of the side members and the transverse members can be minimized to reduce likelihood of damage to the target stand from a projectile and, with no large flat faces directed toward the shooter, to reduce the likelihood of a projectile ricochet off the target stand, which may harm the firearm operator or observers.

FIGS. 7A and 7B illustrate detailed views of the engagement features illustrated in FIG. 1. In particular, FIG. 7A illustrates an engagement feature (identified generically by reference number 113) of the side members 110*a*, 110*b* of FIG. 1, and FIG. 7B illustrates an engagement feature (identified generically by reference number 123) of the transverse members 120, 130 of FIG. 1. Although reference numbers consistent with transverse member 120 are used in this description, it should be recognized that the principles described can be applied to the transverse member 130, as well. In one aspect, the engagement feature 113 can comprise a two part opening 140 having a first portion 141 and a second portion 142. The second portion can have a width 143 less than a width 144 of the first portion. In addition, the complementary engagement feature 123 can comprise a tab 150 having an outside width 154 that is less than the width 144 of the first portion of the two part opening and greater than the width 143 of the second portion of the two part opening. Thus, the first portion can be configured to receive the outside width of the engagement tab therethrough and the second portion can be configured to maintain the engagement tab in the two part opening. When incorporated into the side members and the transverse members, these interfacing features can facilitate binding of the lower and upper transverse members with the side members.

In one aspect, the opening 140 can comprise a T-shaped configuration, where the first portion 141 is a cross portion and the second portion 142 is a post portion 142. The post portion can be located below the cross portion. In addition, the tab 150 can comprise a head portion 151 and a neck portion 152 separating the head portion from a shoulder 127 of the main body portion 121. The width 154 of the head portion can be greater than a width 153 of the neck portion. Thus, the cross portion can be configured to receive the head portion of the engagement tab therethrough and the post portion can be configured to receive the neck portion of the engagement tab. When incorporated into the side members and the transverse members, these interfacing features can facilitate binding of the lower and upper transverse members with the side members.

In one aspect, a distance 155 between the head portion 151 and the shoulder 127 can be configured to facilitate binding of the lower and upper transverse members 120, 130 with the side members 110*a*, 110*b*. In another aspect, the width 153 of the neck portion 152 and the width 143 of the post portion 142 can be configured to facilitate binding of the lower and upper transverse members with the side members. For example, the width 153 and the width 143 can be configured to provide an interference fit between the neck portion and the post portion. In one aspect, opposite sides 146*a*, 146*b* of the post portion can be tapered to facilitate assembly/disassembly when such an interference fit exists. The interfacing engagement features of the side members and the transverse members can therefore provide interlocking components that bind together to provide a stable target stand and that are easy to assemble/disassemble without tools.

In one aspect, further illustrated in FIG. 1, the system 100 can include a carrying case 104 configured to contain the side members 110*a*, 110*b* and the transverse members 120, 130 and facilitate their transport by a user. The components of the target stand 101 can be compact and relatively small in size when disassembled to facilitate fitting in the carrying case for transport and/or storage by the user. For example, the side members and the transverse members can each be substantially planar or flat to allow planar stacking of the members upon disassembly. The entire target stand can therefore be collapsible and portable. In this respect, the members shown in the figures can have symmetric views such that each of the back and front sides appear the same. In one aspect, the various components of the target stand 101 can be configured to facilitate ease of carrying or transport by the user, such as minimized size and/or weight. For example, the transverse members can have main body portions 121, 131 sized sufficient to accommodate target support openings 125 while minimizing excess material not needed to provide structural support, such as by minimizing a width 128, 138 (see FIGS. 3 and 4, respectively). In another example, the side members 110*a*, 110*b* can have cutouts or openings 107*a*, 107*b* to reduce or minimize weight while maintaining structural integrity.

Figure 8A:
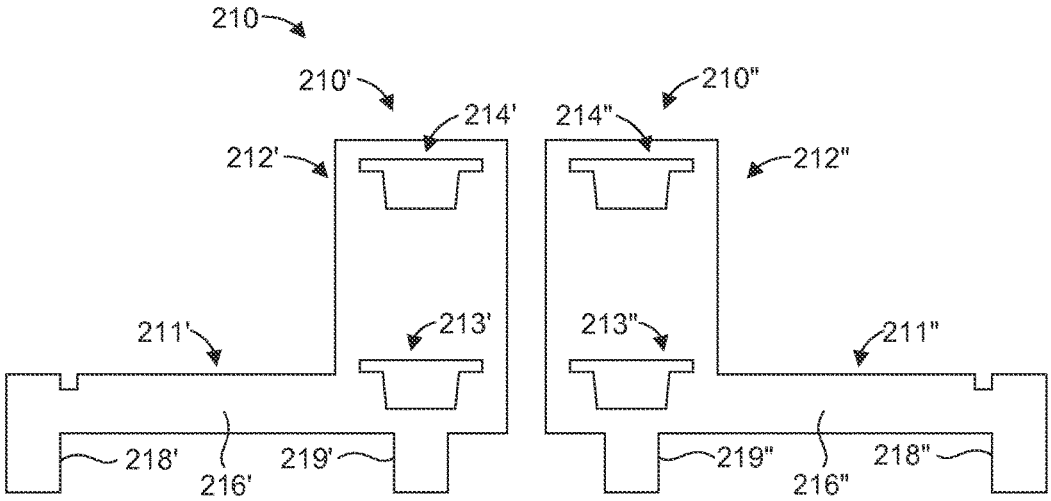
FIGS. 8A and 8B illustrate a two piece side member of a target stand in accordance with another example of the present disclosure.
Figure 8B:
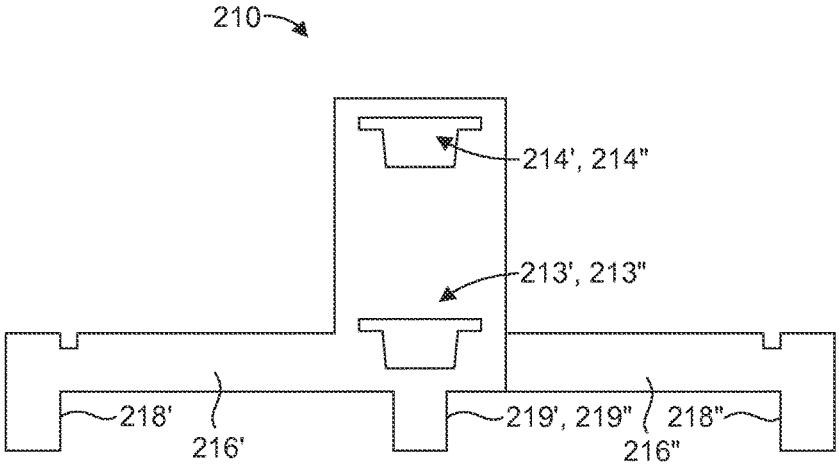

FIGS. 8A and 8B illustrate a side member 210 in accordance with another example of the present disclosure. The side member 210 is similar in many respects to the side member 110*a*, 110*b* discussed above, and may be used as a substitute for one or both of the side members 110*a*, 110*b* in the target stand 101. In this case, the side member 210 comprises two individual components 210', 210" coupleable by the transverse members 120, 130 when assembled. Each component 210', 210" can have a base portion 211', 211" and an upright portion 212', 212" with engagement features 213', 214', 213", 214'. The base portions can have an extension arm 216', 216" and feet 218', 219', 218", 219". Thus, when assembled as shown in FIG. 8B with the upright portions overlapped such that the lower and upper engagement features are aligned, the two components can be coupled together to form the side member 210, which is functionally equivalent in many respects to the side members 110*a*, 110*b*. The separate components of the side member 210 can provide an even more compact disassembled storage and transport configuration than that of a comparably sized side member 110*a*, 110*b*.

Figure 9:
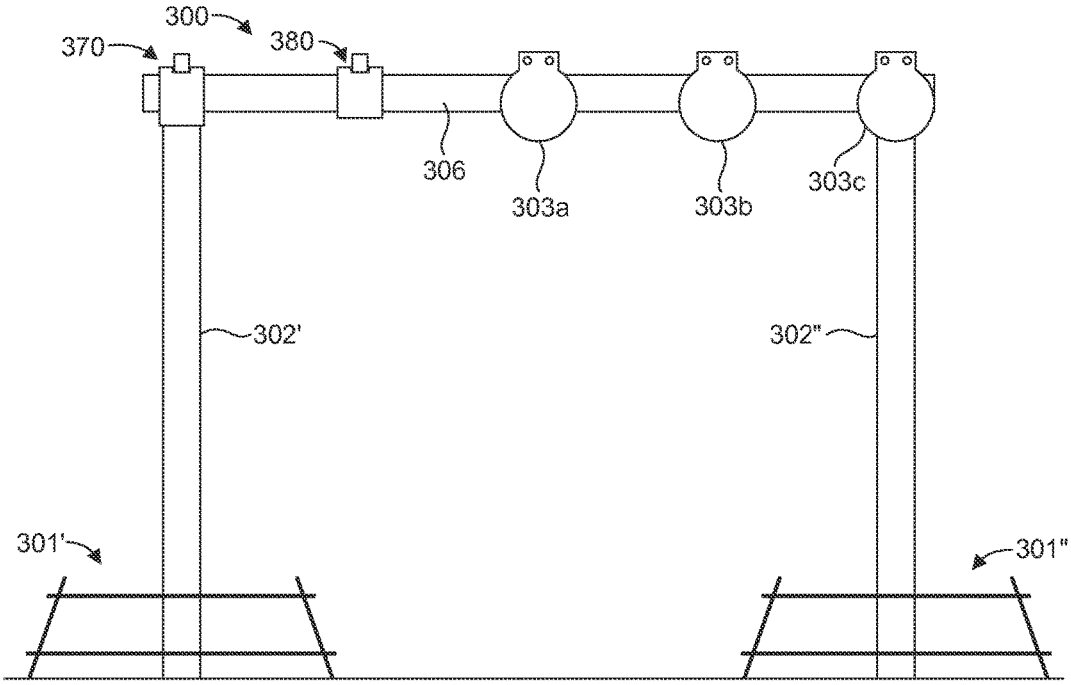
FIG. 9 illustrates a target stand system in accordance with another example of the present disclosure.

FIG. 9 illustrates a target stand system 300 in accordance with another example of the present disclosure. In this case, the system can include multiple target stands 301', 301" to increase the capacity to support targets over a single target stand. For example, the target stands can engage a target support 302', 302", which can be coupled to an additional target support component 306 that spans between the target supports to couple with and position targets 303*a-c*. The target stands can therefore be operable together to support the targets, which may be larger in quantity and/or size than what a single target stand could support. It should be recognized that the target stand systems and target stands disclosed herein can have many uses, such as supporting targets, supporting displays (e.g., commercial or residential goods), etc.

Figure 10A:
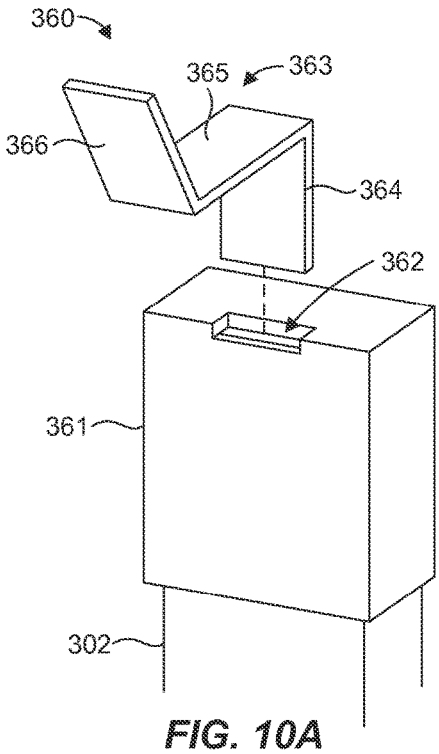
FIGS. 10A and 10B illustrate a target mount in accordance with an example of the present disclosure.
Figure 10B:
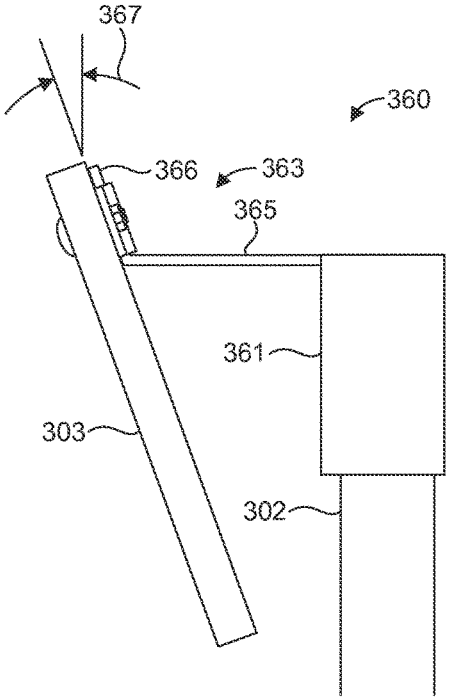

FIGS. 10A and 10B illustrate a target mount 360 in accordance with an example of the present disclosure. In one aspect, the target mount can be configured to interface with and couple to a target support, such as the target support 102 of FIG. 1, to couple with a target. For example, the target mount can include a cap 361 that can fit on an end of a target support 302. The cap can include an opening 362 to receive a hanger 363, which can be configured to interface with and couple to a target 303. In one aspect, the hanger can include an insert portion 364 to be received within the opening. The hanger can also include a stem 365 to extend an interface portion 366 of the hanger away from the target support to provide clearance for the target and the target support. The internal dimensions of the cap can be such that the end of the target support and the insert portion can both be accommodated within the cap. In one aspect, the interface portion can be configured to orient the target at an angle 367 such that a projectile hitting the target will be deflected downward to avoid hitting the shooter or bystanders and dissipate energy away from the target, thereby extending target life. The angle can be from about 5 degrees to about 35 degrees, with about 20 degrees being adequate for many cases.

Figure 11:
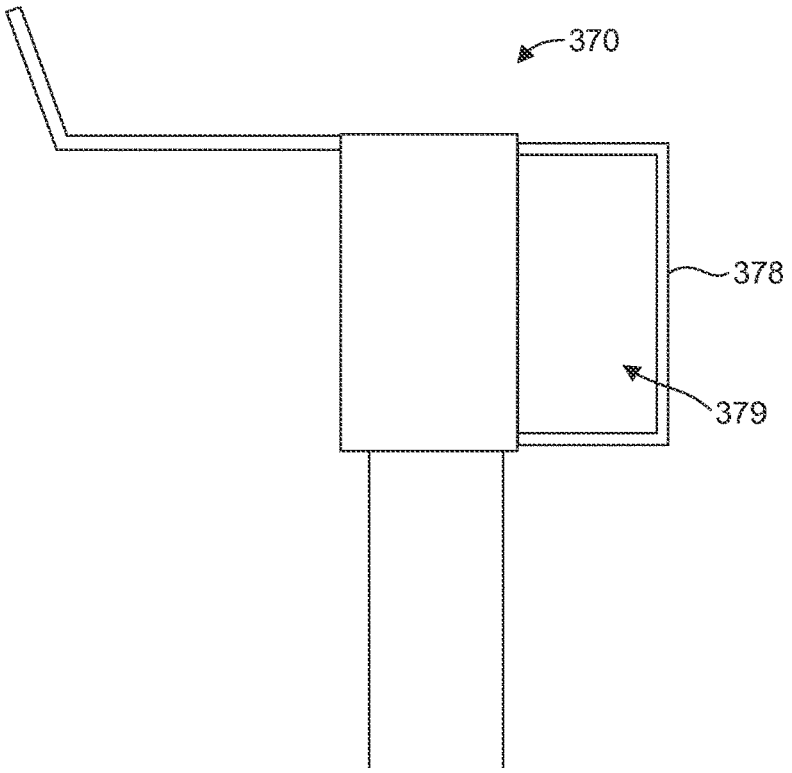
FIG. 11 illustrates a target mount in accordance with another example of the present disclosure.

FIG. 11 illustrates a target mount 370 in accordance with another example of the present disclosure. The target mount 370 can be used, as illustrated, to assemble the target system 300 of FIG. 9. The target mount 370 is similar to the target mount 360 in many respects but adds a lateral target support coupling feature 378 to the basic structure and components described above with reference to FIGS. 10A and 10B. For example, the lateral target support coupling feature can include an opening 379 to receive the additional target support component 306 of FIG. 9. The lateral target support coupling feature can be used to couple with the additional target support component to enable expansion of the target rack system 300 to include multiple target racks.

Figure 12:
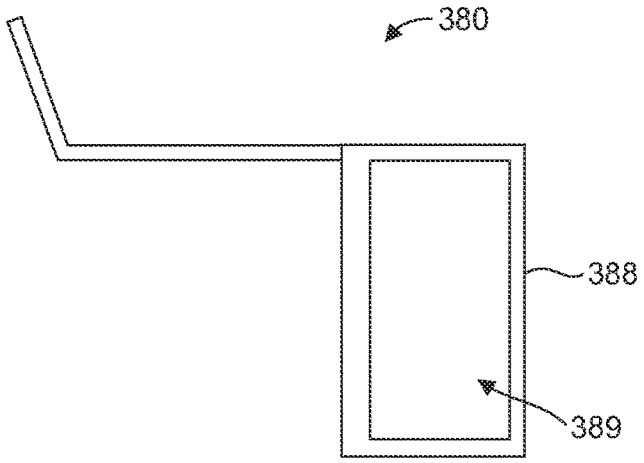
FIG. 12 illustrates a target mount in accordance with yet another example of the present disclosure.

FIG. 12 illustrates a target mount 380 in accordance with yet another example of the present disclosure. The target mount 380 can be used, as illustrated, to assemble the target system 300 of FIG. 9. The target mount 380 is similar to the target mount 370 in many respects and includes a lateral target support coupling feature 388. Unlike the target mount 370, which can couple with vertical and/or horizontal target supports, the target mount 380 is configured to couple exclusively with a lateral target support, such as the additional target support component 306 of FIG. 9. For example, the lateral target support coupling feature can include an opening 389 to receive the additional target support component. Once installed, the target mount 380 can be moved laterally to any desired position to couple with and support a target. Any suitable number of target mounts 380 can be included on a given horizontal target support. In one aspect, the target mounts disclosed herein can be assembled without the use of tools.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A target stand, comprising:

a first side member and a second side member, each side member having a base portion, and an upright portion extending from the base portion and having at least one engagement feature; and a first transverse member and a second transverse member, each transverse member having a main body portion, and complimentary engagement features extending from opposite ends of the main body portion, at least one of the transverse members having a target support portion that at least partially defines a plurality of target support openings configured to interface with a target support and wherein at least one of the target support openings is vertically oriented, shaped as a through hole, and sized to pass only a single 2×4 vertically therethrough as the target support which extends above and below the first and second transverse members allowing the 2×4 to rest on a support ground surface, wherein the first transverse member and the second transverse member are horizontally spaced apart from one another, wherein the complimentary engagement features of the first transverse member are securable to the at least one engagement feature of the first and second side members to secure the first transverse member to the first and second side members, and the complimentary engagement features of the second transverse member are securable to the at least one engagement feature of the first and second side members to secure the second transverse member to the first and second side members, and wherein a distance between an upper portion of the first and second side members is different than a distance between a lower portion of the first and second side members such that the first and second transverse members bind with the first and second side members and cause the first and second side members to be disposed at an angle relative to one another when assembled.

2. The target stand of claim 1, wherein each complimentary engagement feature is a tab which comprises a head portion, and a neck portion separating the head portion from a shoulder of the main body portion, a width of the head portion being greater than a width of the neck portion.

3. The target stand of claim 2, wherein a distance between the head portion and the shoulder is configured to facilitate binding of the first and second transverse members with the first and second side members.

4. The target stand of claim 2, wherein each engagement feature is an opening which comprises a T-shaped configuration having a cross portion and a post portion, the post portion being located below the cross portion, and wherein the cross portion is configured to receive the head portion of the engagement tab therethrough and the post portion is configured to receive the neck portion of the engagement tab to facilitate binding of the first and second transverse members with the first and second side members.

5. The target stand of claim 1, wherein each of the engagement features comprises a two part opening having a first portion and a second portion, the second portion having a width less than a width of the first portion.

6. The target stand of claim 5, wherein each complimentary engagement feature is a tab having an outside width that is less than the width of the first portion of the two part opening and greater than the width of the second portion of the two part opening.

7. The target stand of claim 1, wherein the at least one engagement feature includes a lower engagement feature and an upper engagement feature.

8. The target stand of claim 1, wherein at least one of the plurality of target support openings is defined at least in part by a retaining wall to secure the target support against lateral movement and maintain the target support in a vertical orientation.

9. The target stand of claim 1, wherein each target support opening is configured to interface with a different target support.

10. The target stand of claim 1, wherein the base portion comprises an extension arm to provide stability for the target stand.

11. The target stand of claim 1, wherein each side member comprises two individual components coupleable by the first and second transverse members when assembled, each component having an extension arm to provide stability for the target stand.

12. The target stand of claim 1, wherein a frontal area of the first and second side members and the first and second transverse members is minimized to reduce damage to the target stand and reduce the likelihood of a projectile ricochet off the target stand.

13. The target stand of claim 1, wherein the first and second side members and the first and second transverse members are each substantially planar to allow planar stacking of the members upon disassembly.

14. The target stand of claim 13, wherein the first and second side members and the first and second transverse members are formed of metal plates having a thickness from 1/16" to 1/4".

15. A target stand system, comprising:

a target support coupleable to a target and configured to position the target; and a target stand engaged with the target support, the target stand including a first side member and a second side member, each side member having a base portion, and an upright portion extending from the base portion and having a lower engagement feature and an upper engagement feature, and a first transverse member and a second transverse member, each transverse member having a main body portion, and complimentary engagement features extending from opposite ends of the main body portion, at least one of the transverse members having a target support portion that at least partially defines a plurality of target support openings configured to interface with a target support and wherein at least one of the target support openings is vertically oriented, shaped as a through hole, and sized to pass only a single 2×4 vertically therethrough as the target support which extends above and below the first and second transverse members allowing the 2×4 to rest on a support ground surface, wherein the first transverse member and the second transverse member are horizontally spaced apart from one another, wherein the complimentary engagement features of the first transverse member are securable to at least one of the upper and lower engagement features of the first and second side members to secure the first transverse member to the first and second side members, and the complimentary engagement features of the second transverse member are securable to at least one of the upper and lower engagement features of the first and second side members to secure the second transverse member to the first and second side members, and wherein a distance between the upper engagement features is different than a distance between the lower engagement features such that the first and second transverse members bind with the first and second side members and cause the first and second side members to be disposed at an angle relative to one another when assembled.

16. The system of claim 15, further comprising a second target support and a second target stand engaged with the second target support, wherein the target is coupled to the second target support such that the first target stand and the second target stand are operable together to support the target.

17. A target stand, comprising:

a first side member and a second side member, each side member having a base portion, and an upright portion extending from the base portion and having at least one engagement feature; and a first transverse member and a second transverse member, each transverse member having a main body portion, and complimentary engagement features extending from opposite ends of the main body portion, at least one of the transverse members having a target support portion that at least partially defines a plurality of target support openings configured to interface with a target support and wherein at least one of the target support openings is vertically oriented, shaped as a through hole, and sized to pass only a single 2×4 vertically therethrough as the target support which extends above and below the first and second transverse members allowing the 2×4 to rest on a support ground surface, wherein the first transverse member and the second transverse member are horizontally spaced apart from one another, wherein the complimentary engagement features are securable to the at least one engagement feature of the first and second side members to secure the first and second transverse members to the first and second side members, and wherein the first and second side members are secured and disposed at an angle relative to one another when assembled.

* * * * *